US006518703B1

(12) United States Patent
Hochi et al.

(10) Patent No.: US 6,518,703 B1
(45) Date of Patent: Feb. 11, 2003

(54) ELECTRODELESS DISCHARGE ENERGY SUPPLY APPARATUS AND ELECTRODELESS DISCHARGE LAMP DEVICE USING SURFACE WAVE TRANSMISSION LINE

(75) Inventors: Akira Hochi, Nara (JP); Mamoru Takeda, Kyoto (JP); Kazuyuki Sakiyama, Shijyonawate (JP)

(73) Assignee: Matsushita Electrical Industrial Co., Ltd., Osaka (JP)

( * ) Notice: Subject to any disclaimer, the term of this patent is extended or adjusted under 35 U.S.C. 154(b) by 0 days.

(21) Appl. No.: 09/423,908

(22) PCT Filed: Mar. 11, 1999

(86) PCT No.: PCT/JP99/01167

§ 371 (c)(1),
(2), (4) Date: Nov. 16, 1999

(87) PCT Pub. No.: WO99/48135

PCT Pub. Date: Sep. 23, 1999

(30) Foreign Application Priority Data

Mar. 16, 1998 (JP) ..... 10-065012

(51) Int. Cl.[7] ..... H01J 65/04; H01J 23/42
(52) U.S. Cl. ..... 315/39; 315/39.3; 315/248
(58) Field of Search ..... 315/39, 39.3, 248

(56) References Cited

U.S. PATENT DOCUMENTS

| | | | | |
|---|---|---|---|---|
| 3,663,858 A | * | 5/1972 | Lisitano | 315/39 |
| 3,814,983 A | * | 6/1974 | Weissfloch et al. | 315/39 |
| 4,347,419 A | * | 8/1982 | Jasper, Jr. | 315/3.5 X |
| 4,485,332 A | | 11/1984 | Ury et al. | 315/112 |
| 4,507,587 A | | 3/1985 | Wood et al. | 315/39 |
| 4,695,757 A | | 9/1987 | Ury et al. | 313/44 |
| 4,749,915 A | | 6/1988 | Lynch et al. | 315/248 |
| 4,789,809 A | * | 12/1988 | Christensen | 315/39 |
| 5,072,157 A | | 12/1991 | Greb et al. | 315/248 |
| 5,592,047 A | | 1/1997 | Park et al. | 313/484 |

FOREIGN PATENT DOCUMENTS

| | | |
|---|---|---|
| DE | 3318795 | 12/1983 |
| DE | 4100462 | 7/1991 |
| EP | 225753 | 6/1987 |
| EP | 0 357 453 | 3/1990 |
| EP | 438253 | 7/1991 |
| JP | 59-86153 | 5/1984 |
| JP | 62-58565 | 3/1987 |
| JP | 63-150851 | 6/1988 |
| JP | 2-192606 | 7/1990 |
| JP | 10-40874 | 2/1998 |
| JP | 10040874 | 2/1998 |

OTHER PUBLICATIONS

Japanese language search report for Int'l appln No. PCT/JP99/01167 dated Jun. 15, 1999.
European Search Report dated Aug. 27, 2001, Application No. EP99 93 9859.

* cited by examiner

*Primary Examiner*—Benny T. Lee
(74) *Attorney, Agent, or Firm*—RatnerPrestia

(57) ABSTRACT

Relatively uniform high frequency energy can be applied to a planar or linear discharge space and a more uniform discharge can be produced by using an electrodeless discharge energy supply apparatus which comprises a surface wave transmission line 11 for exciting a surface wave by a high frequency, the surface wave transmission line 11 being formed from a conductive material having a periodic array of corrugations 14, wherein using the surface wave produced in the vicinity of the surface wave transmission line 11, energy necessary to produce an electrodeless discharge is supplied to an electrodeless discharge tube 12.

9 Claims, 11 Drawing Sheets

ELECTRODELESS DISCHARGE ENERGY SUPPLY APPARATUS AND ELECTRODELESS DISCHARGE LAMP DEVICE USING SURFACE WAVE TRANSMISSION LINE

This application is a U.S. National Phase Application of PCT International Application PCT/JP999/01167.

TECHNICAL FIELD

The present invention relates to an electrodeless discharge energy supply apparatus for supplying high frequency energy necessary to produce an electrodeless discharge, and an electrodeless discharge lamp apparatus using the same.

BACKGROUND ART

Compared with electroded arc discharge lamps, high frequency electrodeless discharge lamps have the excellent advantages that electromagnetic energy can be easily coupled to fills, that mercury can be excluded from the fills used for discharge light emission, and that high luminous efficacy is attainable. Furthermore, since there are no electrodes within discharge space, blackening of bulb inner walls due to electrode evaporation does not occur. This significantly improves lamp life. Because of these features, high frequency electrodeless discharge lamps have been researched vigorously in recent years as the next generation of discharge lamps.

Means known in the prior art for supplying high frequency energy necessary for an electrodeless discharge include a cavity resonator such as one described in Japanese Patent Unexamined Patent Publication No. Sho 59-86153.

FIG. 14 shows the construction of a prior art electrodeless discharge lamp apparatus using a cavity resonator as an electrodeless discharge energy supply apparatus, disclosed in Japanese Patent Unexamined Patent Publication No. Sho 59-86153 "Microwave Generation Type Electrodeless Lamp for Producing High Luminous Output."

The electrodeless discharge lamp 131 constructed from an optically transmissive material, such as quartz glass, filled with a discharge medium, such as a rare gas or a metal, is placed inside the cavity resonator 132 constructed from a metallic conductor. High frequency energy generated by an oscillator such as a magnetron propagates along a waveguide or the like and is coupled into the cavity resonator 132 through a high frequency coupling slot 133. A resonant standing wave occurs within the cavity resonator 132, and a discharge plasma is produced within the electrodeless discharge lamp 131 by the energy of the resonant standing wave. Light radiation emitted from the electrodeless discharge lamp is taken outside through a metallic mesh provided in an opening 134.

Since the prior art electrodeless discharge energy supply apparatus and electrodeless discharge lamp apparatus use a cavity resonator as the energy supply means, an electric field strength distribution based on the guide wavelength occurs within the cavity resonator. For example, at high frequencies of 2.45 GHz, widely used as an industrial frequency band, free space wavelength is about 12 cm. Therefore, if a discharge is produced within a discharge area wider than the half wavelength (about 6 cm) by using such a prior art apparatus, the magnitude of the electric field strength varies greatly, depending on the location within the discharge area. This has resulted in the problem that a uniform discharge cannot be obtained because of variations in discharge intensity among locations within the discharge area. The prior art apparatus such as described above has therefore not been suitable for applications such as a plane light source or a line light source that demand a uniform discharge over a wide discharge area wider than the wavelength of the applied high frequency.

There is, therefore, a need to develop an electrodeless discharge energy supply apparatus that is capable of applying a uniform electric field over a desired discharge area so that a uniform discharge can be produced over a discharge area wider than the wavelength of the applied high frequency.

DISCLOSURE OF THE INVENTION

In view of the above problem with the prior art energy supply apparatus, it is an object of the present invention to provide an electrodeless discharge energy supply apparatus which, compared with the prior art cavity resonator type, is capable of producing a more uniform discharge over a discharge area wider than the wavelength of the applied high frequency, and also provide an electrodeless discharge lamp apparatus using the same.

One aspect of the present invention is an electrodeless discharge energy supply apparatus comprising excitation means, having a prescribed periodic structure, for exciting a surface wave by a high frequency, wherein energy necessary to produce an electrodeless discharge is supplied using said excited surface wave.

Another aspect of the present invention is an electrodeless discharge energy supply apparatus, wherein the excitation means is a surface wave transmission line having electrical conductivity and formed in a substantially planar shape, and the surface wave supplied as the energy is a surface wave produced in the vicinity of the surface wave transmission line.

Still another aspect of the present invention is an electrodeless discharge energy supply apparatus, wherein the excitation means comprises (1) a planar substrate formed from a dielectric material and (2) a surface wave transmission line formed from a conductive material on the substrate, and wherein the surface wave supplied as the energy is a surface wave produced in the vicinity of the surface wave transmission line.

Yet another aspect of the present invention is an electrodeless discharge energy supply apparatus, wherein the excitation means is a surface wave transmission line having electrical conductivity and formed in a substantially cylindrical or semicylindrical shape, and the surface wave supplied as the energy is a surface wave produced in the vicinity of the surface wave transmission line.

With the above construction, a more uniform high frequency electric field can be applied to a planar or linear discharge space.

Still yet another aspect of the present invention is an electrodeless discharge lamp apparatus comprising: a high frequency oscillation means for generating high frequency energy; a high frequency propagation means for propagating the generated high frequency energy; an electrodeless discharge energy supply apparatus as described in any one of the present invention, a high frequency coupling means for coupling the propogated high frequency energy into the electrodeless discharge energy supply apparatus; and an electrodeless discharge lamp in which a discharge is produced by a surface wave generated by the electrodeless discharge energy supply apparatus.

With the above construction, a plane or line light source can be achieved that provides a more uniform luminance distribution over a discharge area wider than the wavelength of the applied high frequency.

The term "high frequency" in this specification refers to electromagnetic waves at frequencies of 1 MHz to 100 GHz. The present invention offers an advantageous effect particularly in microwave regions of frequencies ranging from 300 MHz to 30 GHz.

DESCRIPTION OF THE REFERENCE NUMERALS

11, 21. PLANAR CORRUGATED TYPE SURFACE WAVE TRANSMISSION LINE

12, 22, 42, 102, 112, 131. ELECTRODELESS DISCHARGE TUBE

51. STUB TYPE SURFACE WAVE TRANSMISSION LINE

61, 81. INTERDIGITAL TYPE SURFACE WAVE TRANSMISSION LINE

71, 91. PLANAR HELIX TYPE SURFACE WAVE TRANSMISSION LINE

83, 93. DIELECTRIC SUBSTRATE

101, 111. SEMICYLINDRICAL CORRUGATED TYPE SURFACE WAVE TRANSMISSION LINE

121. CYLINDRICAL HELIX TYPE SURFACE WAVE TRANSMISSION LINE

BEST MODE FOR CARRYING OUT THE INVENTION

The preferred embodiments of the present invention will be described below with reference to FIGS. 1 to 10.

(Embodiment 1)

Figure 1:
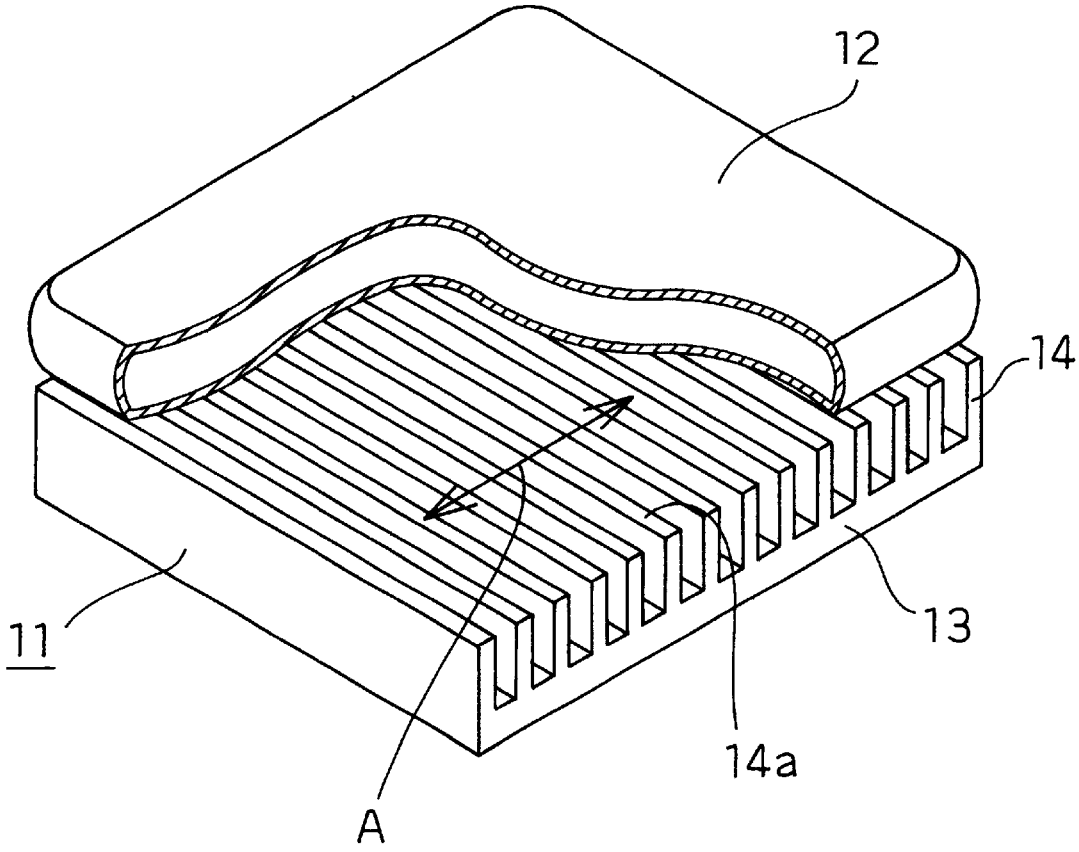
FIG. 1 is a perspective view showing an electrodeless discharge energy supply apparatus using a planar corrugated type surface wave transmission line according to a first embodiment of the present invention.

FIG. 1 is a perspective view of an electrodeless discharge energy supply apparatus using a planar corrugated type surface wave transmission line, wherein reference numeral 11 indicates the planar corrugated type surface wave transmission line. The planar corrugated type surface wave transmission line 11 has a periodic structure in which a plurality of corrugations 14 made of a conductive material, such as copper, aluminum, or like metal, are formed in a periodic fashion on a planar plate 13 made of a similar conductive material, each corrugation being substantially perpendicular to the planar plate 13.

In this periodic structure of the planar corrugated type surface wave transmission line 11, the dimensions of each part are designed so that when high frequency energy of a desired frequency is applied from a coupling antenna (indicated by reference numeral 26 in FIG. 2), a surface wave is excited and propagates on or near the upper ends 14*a* of the corrugations 14 in a direction parallel to the plate 13 and perpendicular to the corrugations 14 (the direction indicated by arrow A in FIG. 1).

By mounting a planar electrodeless discharge tube 12, filled with a discharge medium such as a rare gas or a metal, in close proximity to the upper end portion of the planar corrugated type surface wave transmission line 11, a surface electrodeless discharge can be produced by the electric field of the surface wave generated on the corrugation upper ends 14*a*. Such a discharge can be produced throughout the inside of the electrodeless discharge tube 12, or selectively in the inside portion of the electrodeless discharge tube 12 near the surface wave transmission line 11, depending on the kind, sealing condition, etc. of the sealed discharge medium. The electrodeless discharge tube 12 is formed from quartz glass or like material.

Figure 2:
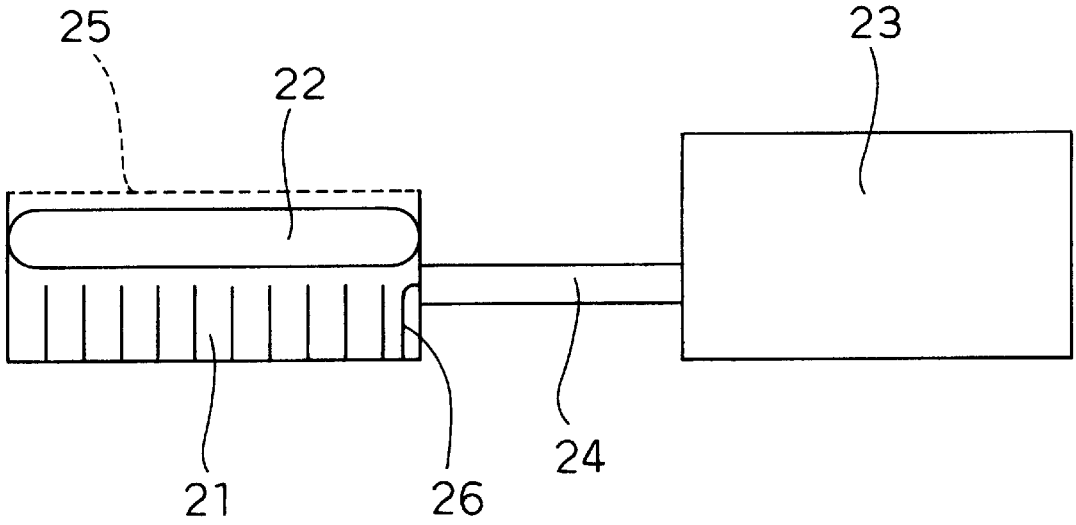
FIG. 2 is a transverse sectional view of an electrodeless discharge lamp apparatus incorporating the planar corrugated type surface wave transmission line according to the first embodiment of the present invention.

FIG. 2 is a transverse sectional view of an electrodeless discharge lamp apparatus incorporating the electrodeless discharge energy supply apparatus that uses the planar corrugated type surface wave transmission line shown in FIG. 1.

As shown in FIG. 2, the high frequency energy generated by a high frequency oscillation means 23 such a magnetron is propagated through a high frequency propagation means 24 such as a waveguide or a coaxial line, and is coupled into the planar corrugated type surface wave transmission line 21 by a high frequency coupling means 26 such as a loop antenna. The electric field of the surface wave excited on the planar corrugated type surface wave transmission line 21 is coupled into the electrodeless discharge lamp 22, thus providing the energy necessary to produce an electrodeless discharge. The light radiation emitted from the electrodeless discharge lamp 22 is taken outside through an optically transmissive high frequency leakage prevention means 25 formed from a metallic mesh. In the planar corrugated type surface wave transmission line, the planar plate 13 in FIG. 1 also serves as a means for preventing high frequency leakage to the side opposite from the light radiation transmission side. In this way, an electrodeless discharge can be produced inside the electrodeless discharge lamp 22, and a plane light source having a relatively uniform luminance distribution can thus be achieved.

Figure 3:
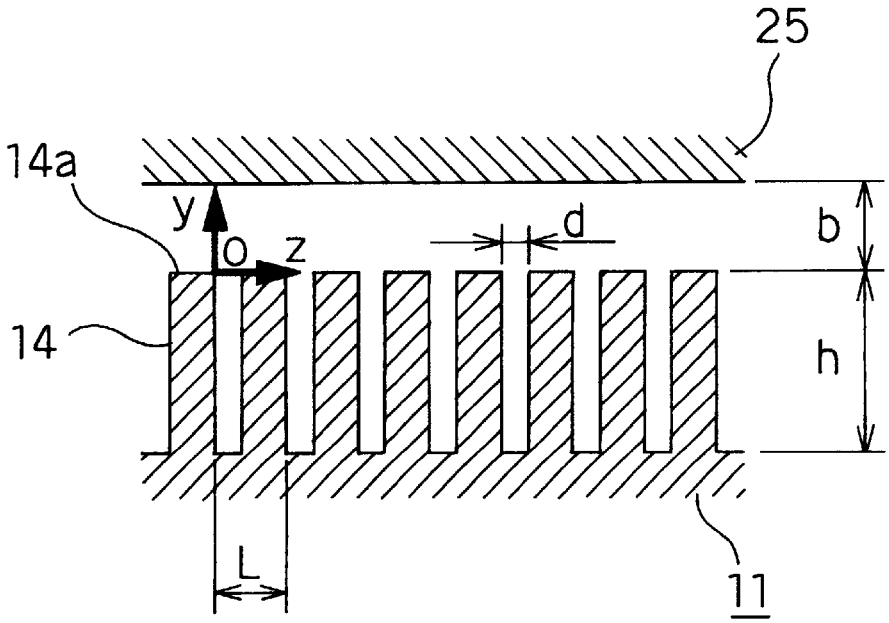
FIG. 3 is a transverse sectional view of the electrodeless discharge energy supply apparatus using the planar corrugated type surface wave transmission line according to the first embodiment of the present invention.

Next, the electric field strength distribution on the planar corrugated type surface wave transmission line 11 will be described with reference to FIG. 3.

The period of the above periodic structure is denoted by L, the spacing between the corrugations 14 by d, and the height of the corrugations 14 by h. Further, using an x-y-z coordinate system, the position of the upper end 14*a* of the corrugations 14 is taken as y=0. Here, the positive direction of the x axis is the direction perpendicular to the plane of the figure and pointing toward the back of that plane. For simplicity of explanation, it is assumed that the planar corrugated type surface wave transmission line 11 is formed from an ideal conductive material with zero electrical resistance.

When a high frequency voltage V is appled between a certain corrugation 14 and another certain corrugation 14, if we consider the high frequency electric field propagating as a surface wave in the z direction for the case of the TM mode in which the electric field is uniform in the x direction, then the electric field $E_z$ in the z direction is expressed by (Equation 1) below.

$$E_z = \sum_{n=1}^{\infty} E_{zn} e^{-j\beta_n z} \qquad \text{[Equation 1]}$$

$$|E_{zn}| = \frac{\sin(\beta_n d/2)}{\beta_n d/2} e^{-\gamma_n y} \frac{V}{L}$$

In this way, the electric field, while changing direction in the z direction, exhibits a distribution such that its strength exponentially decreases the farther away from the corrugation upper end 14*a* in the y direction. Here, $\beta_n$ is a phase constant for the n-th space harmonic, and characteristic value $\gamma_n$ is expressed by (Equation 2) below, using wave number κ.

$$\gamma_n^2 = \beta_n^2 - \kappa^2 \qquad \text{[Equation 2]}$$

In the case of a structure where a conductive shield (corresponding to the high frequency leakage protection means 25 shown in FIGS. 2 and 3) is provided at position y=b (see FIG. 3), the electric field $E_z$ of the n-th space harmonic in the z direction is expressed by (Equation 3) below.

$$|E_{zn}| = \frac{\sin(\beta_n d/2)}{\beta_n d/2} \frac{\sinh\gamma_n(b-y)}{\sinh\gamma_n b} \frac{V}{L} \qquad \text{[Equation 3]}$$

When such a shield 25 is provided, the electric field distribution in the y direction changes, but the surface wave propagates in the z direction as it does when the shield 25 is not provided.

When a discharge occurs, the behavior becomes more complex by being influenced by the impedance component of the discharge plasma. To obtain sufficient impedance matching when viewed from the power supply side, it is desirable to determine optimum dimensional values by experiment.

Figure 4:
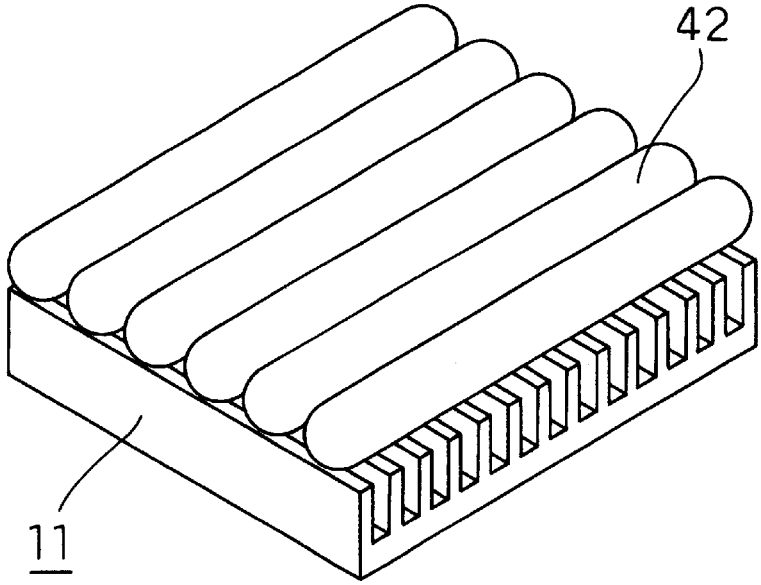
FIG. 4 is a perspective view showing the electrodeless discharge energy supply apparatus using the planar corrugated type surface wave transmission line according to the first embodiment of the present invention.

A planar electrodeless discharge lamp having a single discharge space has been illustrated as an example of the electrodeless discharge tube, but the configuration of the electrodeless discharge tube is not limited to the illustrated one. For example, as shown in FIG. 4, if a plurality of cylindrically shaped electrodeless discharge tubes 42 are arranged in a planar array in close proximity to the upper end portion of the planar corrugated type surface wave transmission line 11, a substantially surface area electrodeless discharge can likewise be obtained by the surface wave.

Figure 5:
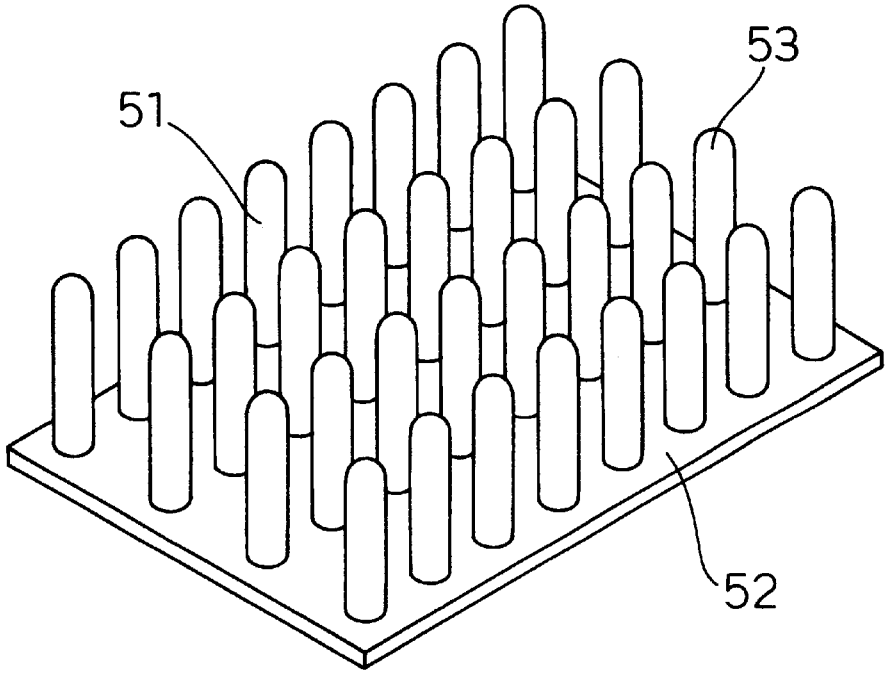
FIG. 5 is a perspective view showing an electrodeless discharge energy supply apparatus using a stub type surface wave transmission line according to the first embodiment of the present invention.
Figure 6:
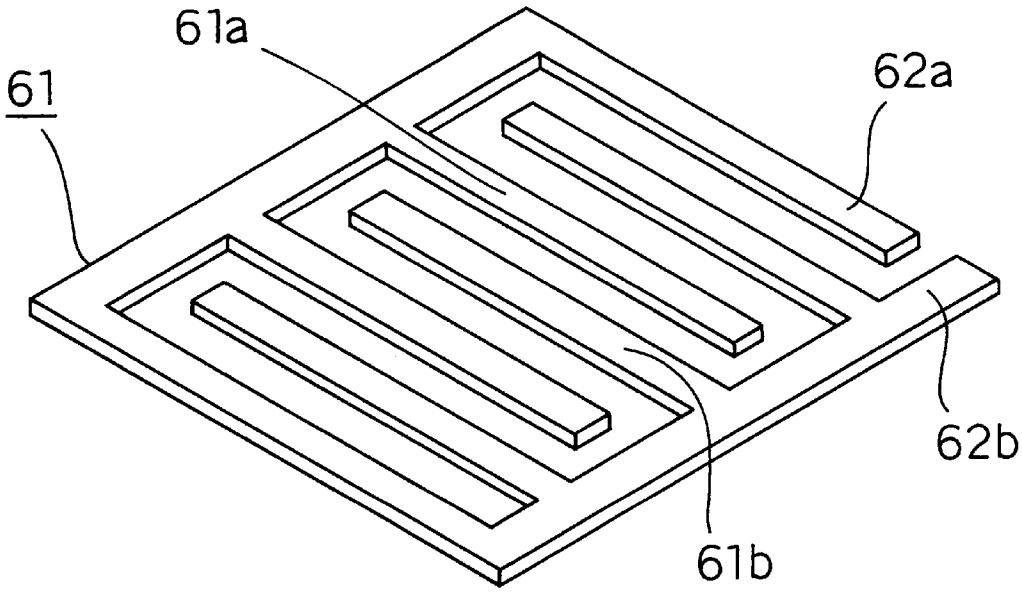
FIG. 6 is a perspective view showing an interdigital type surface wave transmission line according to the first embodiment of the present invention.
Figure 7:
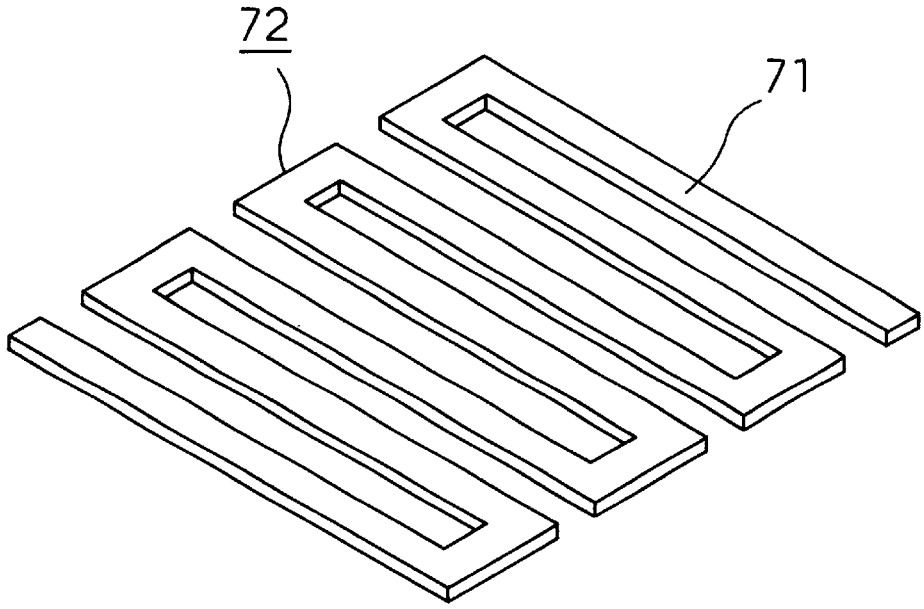
FIG. 7 is a perspective view showing a planar helix type surface wave transmission line according to the first embodiment of the present invention.

Further, the surface wave transmission line that excites surface waves by high frequency energy is not limited to the planar corrugated type surface wave transmission line described above. FIGS. 5 to 7 show other examples of the surface wave transmission line.

FIG. 5 is a perspective view of a stub type surface wave transmission line 51.

As shown in FIG. 5, the stub type surface wave transmission line 51 has a structure in which a plurality of rod-like members (stubs) 53 made of a conductive material are formed in periodic fashion on a planar plate 52 also made of a conductive material. In this case also, if the dimensions of the periodic structure are appropriately designed so that a surface wave is excited and propagates on the upper ends of the stubs 53, a surface area electrodeless discharge can be achieved by mounting an electrodeless discharge tube in close proximity to the upper ends of the stubs 53. In FIG. 5, the rod-like members are shown as being columnar in shape, but it will be appreciated that a similar effect can be obtained if rod-like plates or members of other shape are used.

FIG. 6 is a perspective view of an interdigital type surface wave transmission line 61.

As shown in FIG. 6, the interdigital type surface wave transmission line 61 has a structure in which comb-shaped planar plates 61*a* and 61*b* of periodically repeating pattern, each made of a conductive material, are formed alternately in interlocking fashion. If the dimensions of the periodic structure are designed appropriately, with the application of a high frequency voltage between open ends 62*a* and 62*b* a high frequency electric field propagates between the interlocking comb-shaped members, thus exciting a surface wave. Accordingly, by mounting an electrodeless discharge tube in close proximity to the planar surface of the interdigital type surface wave transmission line 61, a surface area electrodeless discharge can be achieved, as in the case of FIG. 1.

FIG. 7 is a perspective view of a planar helix type surface wave transmission line 72.

As shown in FIG. 7, a planar strip plate 71 made of a conductive material is formed in a periodically repeating continuous zigzag pattern; if the dimensions of the periodic structure are designed appropriately, a surface wave is excited and propagates with an electric field being formed between adjacent strip sections. Accordingly, by mounting an electrodeless discharge tube in close proximity to the planar surface of the planar helix type surface wave transmission line 72, a surface area electrodeless discharge can be achieved, as in the case of FIG. 1.

(Embodiment 2)

The foregoing first embodiment has dealt with examples in which the surface wave transmission line is formed from a conductive material alone. By contrast, the embodiment hereinafter described illustrates examples of structures in which the surface wave transmission line is formed from a conductive material on a substrate made of a dielectric material.

Figure 8:
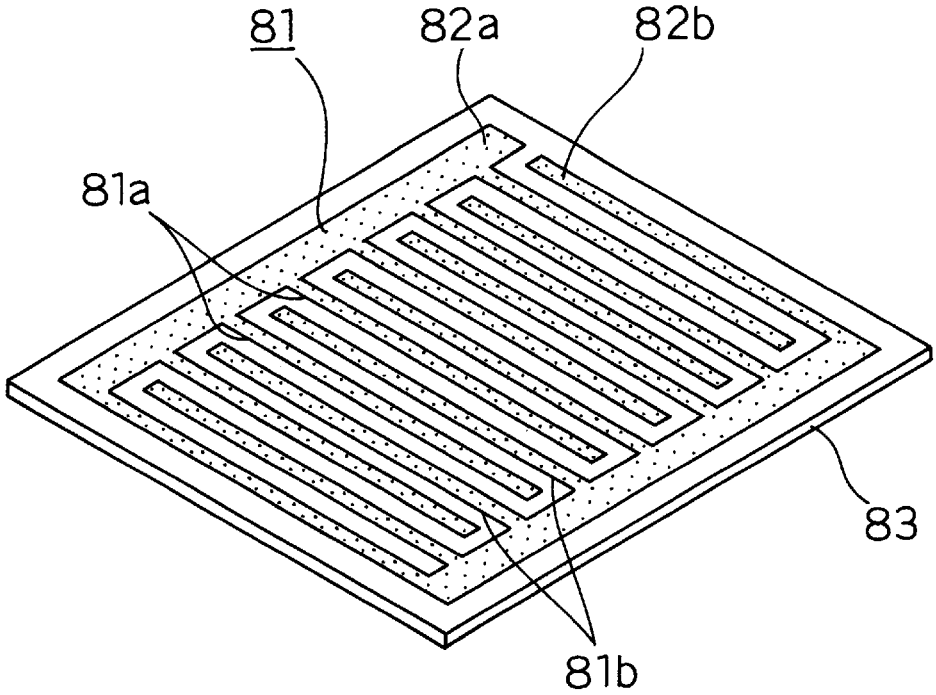
FIG. 8 is a perspective view showing an interdigital type surface wave transmission line according to a second embodiment of the present invention.

FIG. 8 is a perspective view of a structure in which an interdigital type surface wave transmission line 81 is formed on a substrate 83 made of a dielectric material.

As shown in the figure, the interdigital type surface wave transmission line 81 has a structure in which comb-shaped planar plates 81*a* and 81*b* of periodically repeating pattern, each made of a conductive material, are formed alternately in interlocking fashion on the substrate 83 made of a dielectric material. If the dimensions of the periodic structure are designed appropriately, with the application of a high frequency voltage between open ends 82*a* and 82*b* a high frequency electric field propagates between the interlocking comb-shaped members 81*a* and 81*b,* thus exciting a surface wave, as in the case of the interdigital type surface wave transmission line 61 of FIG. 6 consisting only of a conductive material. Accordingly, by mounting an electrodeless discharge tube in close proximity to the planar surface of the interdigital type surface wave transmission line 81 on substrate 83, a surface area electrodeless discharge can be achieved, as in the foregoing embodiment.

Figure 9:
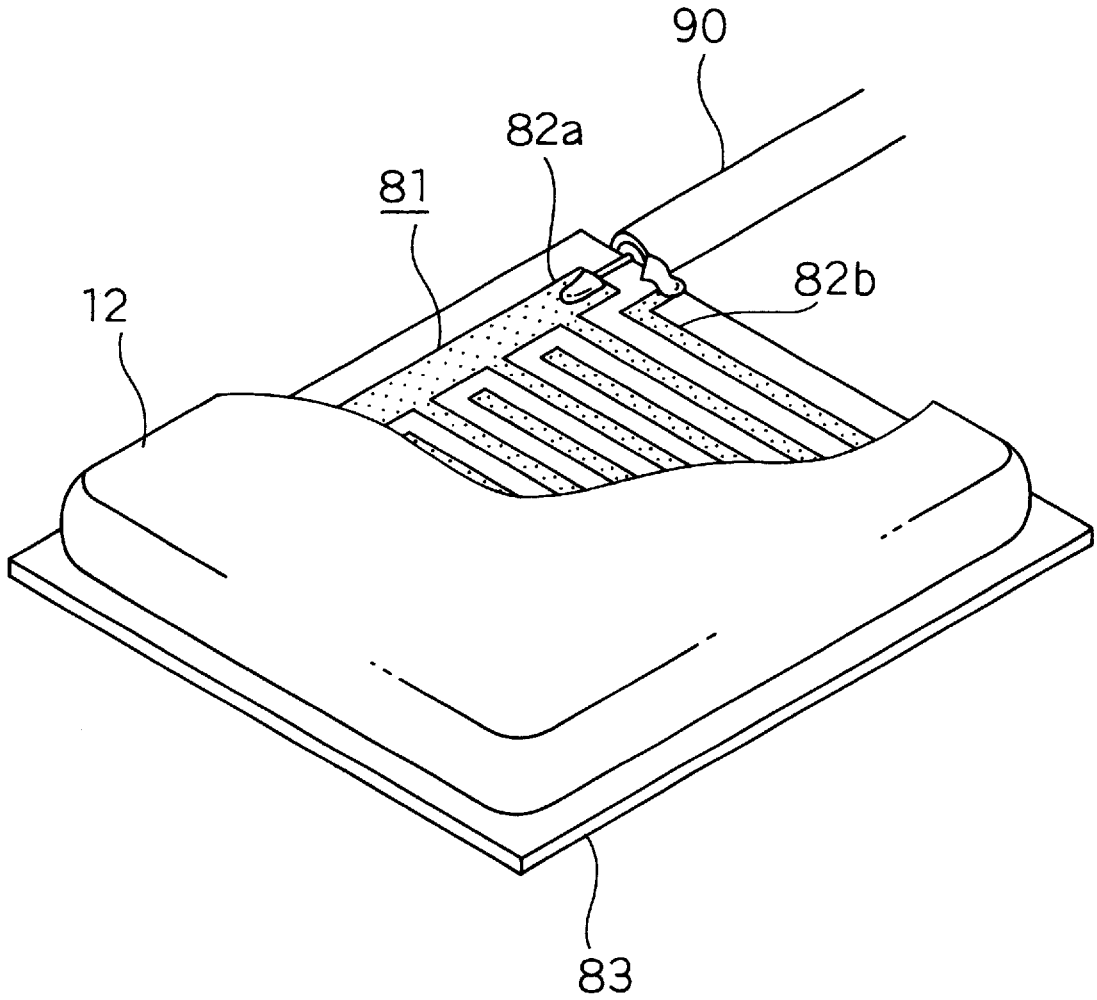
FIG. 9 is a perspective view showing an electrodeless discharge tube mounted above the interdigital type surface wave transmission line according to the second embodiment of the present invention.

FIG. 9 is a perspective view showing the electrodeless discharge tube 12 mounted above the interdigital type surface wave transmission line 81. The center conductor (core) and outer conductor of a coaxial line 90 as the high frequency propagation means are electrically connected to the open ends 82*a* and 82*b,* respectively, by soldering or like method. Thus the high frequency energy propagated through the coaxial line 90 is coupled into the interdigital type surface wave transmission line 81 on substrate 83, thereby exciting a surface wave.

Compared with the construction of the surface wave transmission line using only a conductive material, constructing the surface wave transmission line on a substrate as described above has the advantage that sufficient strength can be obtained for a relatively thin surface wave transmission line. Accordingly, it can be said that the construction of the second embodiment is preferred for applications where a discharge is produced with a relatively small power.

Figure 10:
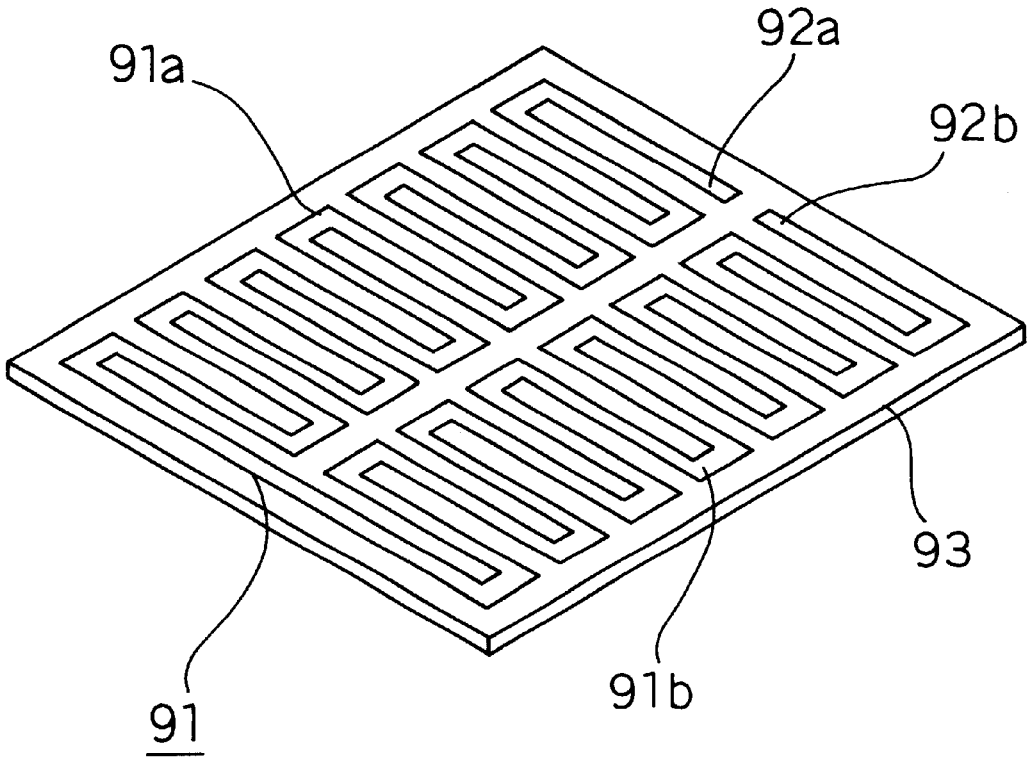
FIG. 10 is a perspective view showing a planar helix type surface wave transmission line according to the second embodiment of the present invention.

The above description has been given by taking the interdigital configuration as an example of the surface wave transmission line, but other types of surface wave transmission line are equally implementable. FIG. 10 shows a structure in which a planar helix type surface wave transmission line is formed on a substrate made of a dielectric material. As shown, planar strip plates 91*a* and 91*b,* each made of a conductive material and formed in a periodically repeating continuous rectangular pattern, are formed on the dielectric substrate 93. If the dimensions of the periodic structure are designed appropriately, with the application of a high frequency voltage between open ends 92*a* and 92*b* a high frequency electric field propagates between adjacent planar strip sections, thus exciting a surface wave, as in the case of the planar helix type surface wave transmission line of FIG. 7 consisting only of a conductive material. Accordingly, by mounting an electrodeless discharge tube in close proximity to the planar surface of the planar helix type surface wave transmission line 91, a surface area electrodeless discharge can likewise be achieved.

In the construction of the surface wave transmission line 81 on the upper surface of the dielectric substrate 83, a double sided substrate with its back surface covered with a conductor may be used as the substra 83. In this case, a microstrip transmission line is formed by the surface wave transmission line 81 and the conductor surface on the back of the substrate 83. This construction allows the use of design parameters and electrical wavelength data widely available for microstrip transmission lines, and facilitates the design of the surface wave transmission line.

(Embodiment 3)

The foregoing first and second embodiments have dealt with examples in which the surface wave transmission line and the electrodeless discharge tube are constructed in planar plate form. By contrast, the embodiment hereinafter described illustrates an example in which the surface wave transmission line is formed in a semicylindrical shape.

Figure 11:
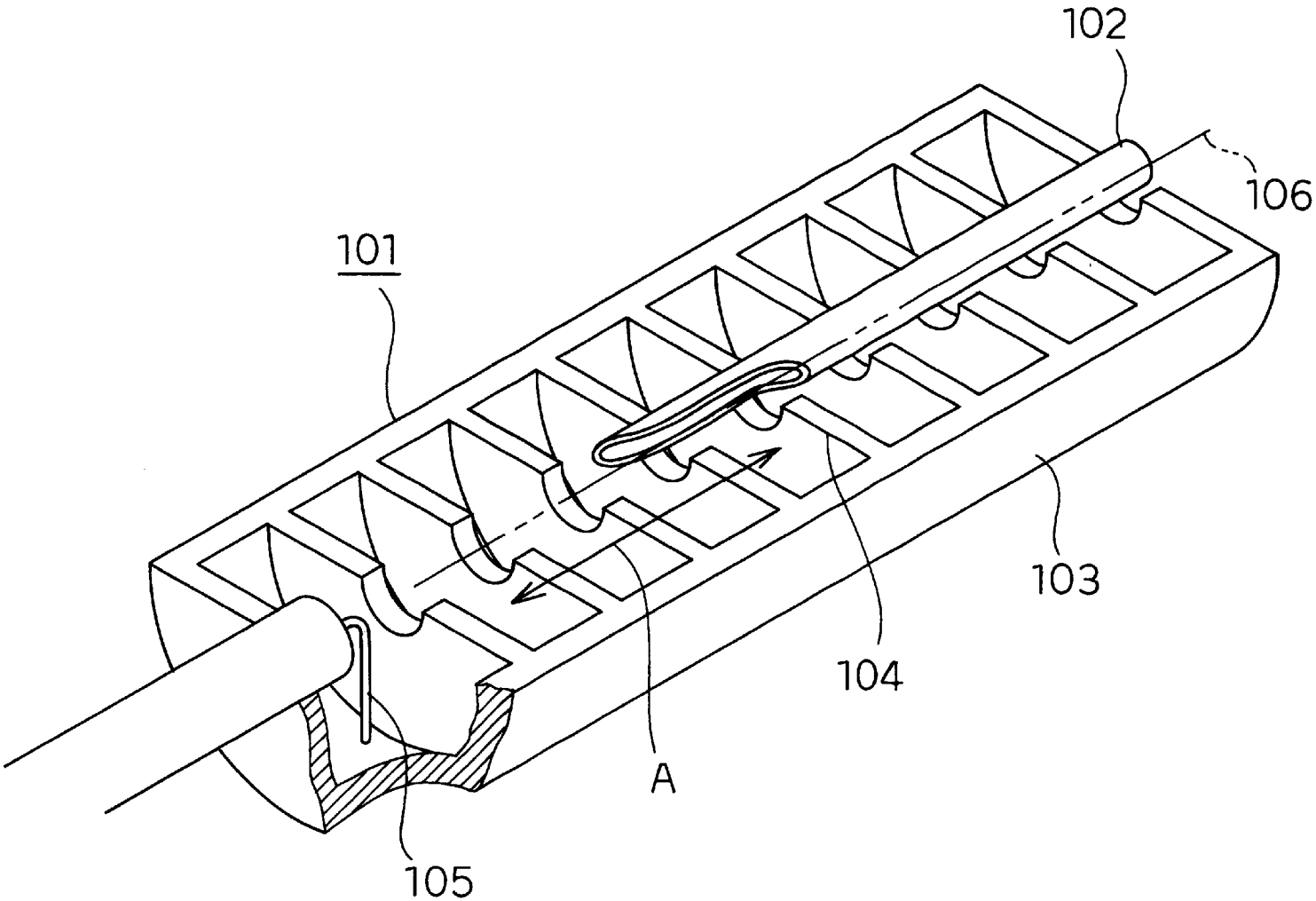
FIG. 11 is a perspective view showing an electrodeless discharge energy supply apparatus using a semicylindrical corrugated type surface wave transmission line according to a third embodiment of the present invention.

FIG. 11 shows a perspective view of an electrodeless discharge energy supply apparatus using a semicylindrical corrugated type surface wave transmission line.

As shown in FIG. 11, the semicylindrical corrugated type surface wave transmission line indicated at 101 is so shaped in order that radiated light from an electrodeless discharge tube 102 is taken in a direction perpendicular to the rotational axis 106 of the semicylindrical structure. The semicylindrical corrugated type surface wave transmission line 101, like the planar type surface wave transmission line shown in the first embodiment, is formed from a conductive material such as copper, aluminum, or like metal. The semicylindrical corrugated type surface wave transmission line 101 contains corrugations 104 which are made of a similar conductive material and are formed at prescribed intervals in a periodic fashion inside the semicylindrical structure, each corrugation being substantially perpendicular to the semicylindrical structure.

In this periodic structure of the semicylindrical corrugated type surface wave transmission line 101, the dimensions of each part are designed so that when high frequency energy of a desired frequency is applied from a coupling antenna 105, a surface wave is excited and propagates on or near the upper ends of the corrugations 104 in a direction parallel to the rotational axis 106 of the semicylindrical structure and perpendicular to the corrugations 104 (the direction indicated by arrow A in FIG. 11).

By mounting a cylindrically shaped electrodeless discharge tube 102, filled with a discharge medium such as a rare gas or a metal, in close proximity to and along the center of the semicylindrical corrugated type surface wave transmission line 101, a linear electrodeless discharge can be produced by the electric field of the surface wave generated near the center of the upper portion of the corrugations 104.

The light emitted from the electrodeless discharge tube 102 is radiated from the opening of the semicylindrical structure 103; in this case, if the interior of the semicylindrical structure 103 is formed as a reflective surface, the radiated light can be utilized more efficiently.

Figure 12:
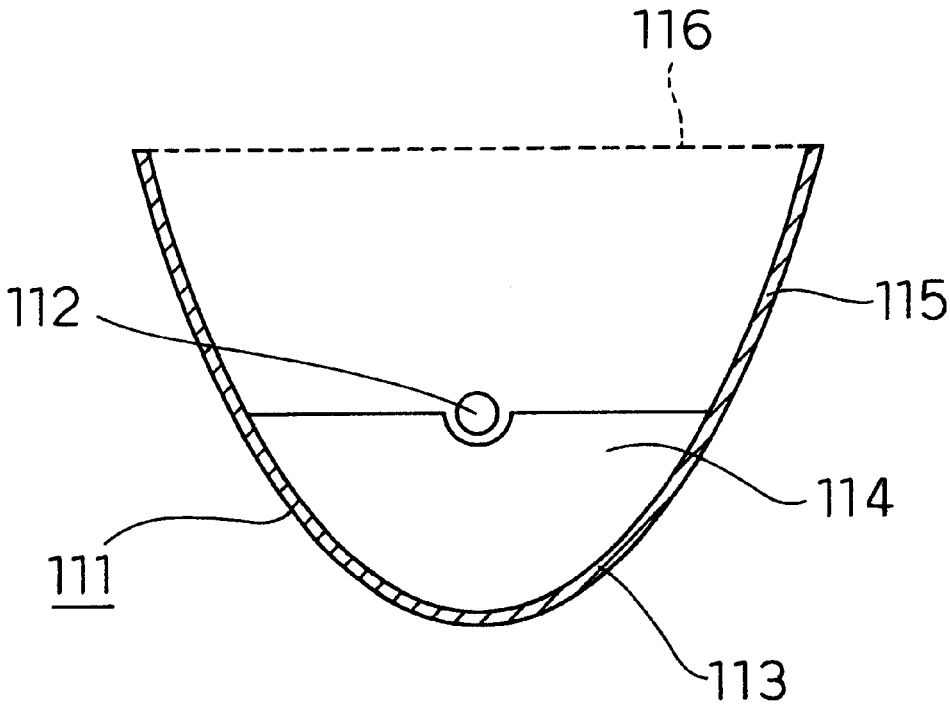
FIG. 12 is a cross sectional view showing the electrodeless discharge energy supply apparatus using the semicylindrical corrugated type surface wave transmission line according to the third embodiment of the present invention.

FIG. 12 shows a cross sectional view of a semicylindrical corrugated type surface wave transmission line 111 having a reflective surface, as a modification of FIG. 11.

As shown in FIG. 12, in the semicylindrical, corrugated type surface wave transmission line 111, the surface wave transmission line is formed by the semicylindrical structure 113 and corrugations 114. The interior side of semicylindrical structure 113 consists of a first optically reflective means (the portion of the corresponding inner wall surface of the semicylindrical structure 103 in FIG. 11) and a second optically reflective means 115, both formed of an optically reflective member such as polished aluminum. The second optically reflective means 115 also has a high frequency leakage protection function. Radiated light from the electrodeless discharge tube 112 is taken outside through a metallic mesh 116 serving as a high frequency leakage protection means. The first and second optically reflective means together provide a curved cross section in order to obtain the desired optical property. The semicylindrical structure 113 need only be formed in a substantially semicylindrical shape; for example, when an optical property that can concentrate light along a straight line is needed, it is desirable that the cross section be shaped in an elliptically curved form. When a collimated beam is needed, a parabolic shape should be employed.

The present embodiment has been described by taking as an example of the surface wave transmission line a semicylindrical corrugated type surface wave transmission line having a substantially semicylindrical shape, but if the radiated light is to be taken out in the axial direction, then the surface wave transmission line can be formed in a completely closed cylindrical shape, not in the semicylindrical shape. In that case, an optically transmissive member for taking out the radiated light should be provided at least in a portion at one end or at both ends of the cylindrical structure.

Figure 13:
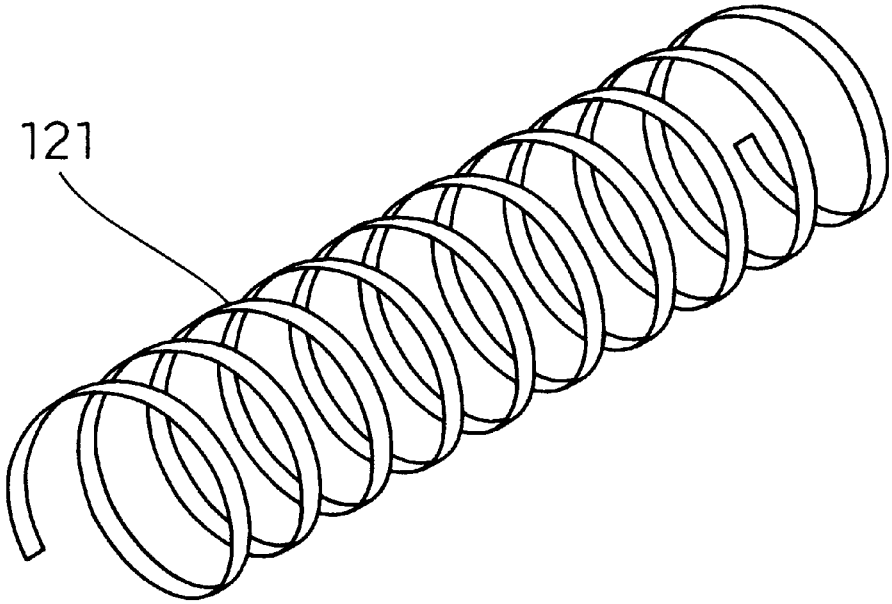
FIG. 13 is a perspective view showing an electrodeless discharge energy supply apparatus using a cylindrical helix type surface wave transmission line according to the third embodiment of the present invention.
Figure 14:
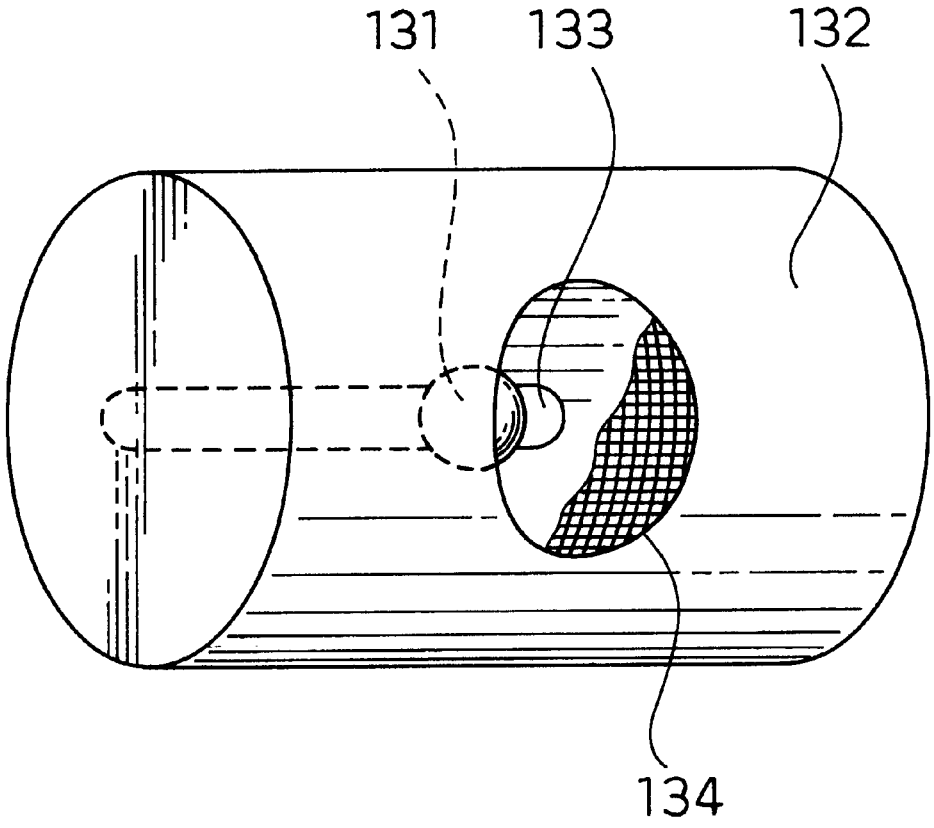
Fig. 14 (PRIOR ART)
FIG. 14 is a perspective view showing an electrodeless discharge energy supply apparatus using a cavity resonator according to the prior art.

In the present embodiment, the semicylindrical corrugated type surface wave transmission line has been shown as an example of the surface wave transmission line, but the configuration is not limited to the illustrated one; as an alternative configuration, an electrodeless discharge tube may be disposed inside a cylindrical helix type surface wave transmission line consisting of a strip member formed in a helix, as indicated by reference numeral 121 in FIG. 13. With this configuration also, the same effect as achieved in the above embodiment can be obtained.

As described above, the present invention is characterized in that the surface wave transmission line of the invention can be constructed in various configurations, and in that the surface wave transmission line is used as an energy supply apparatus for producing an electrodeless discharge. Prior known surface wave transmission lines are used in filters, traveling wave tubes for electron beam control, etc. and many research papers and reference books have been published.

However, the structure of the present invention that uses the surface wave transmission line as an electrodeless discharge energy supply apparatus, and that can achieve an electrodeless discharge relatively uniformly over a surface area or along a straight line, as described above, is totally different from any prior known applications of surface wave transmission lines.

It will be noted, however, that referring to books and other literature of prior art concerning surface waves will be useful in designing a surface wave transmission line suitable for a desired frequency band.

Though the above-described embodiments have dealt only with examples in which the electrodeless discharge energy supply apparatus using a surface wave transmission line is applied to electrodeless discharge lamp apparatus, it will be appreciated that the electrodeless discharge energy supply apparatus of the present invention is not limited in application to electrodeless discharge lamp apparatus. The present invention is also effective, for example, in applications where a uniform plasma over a wide area is needed, such as in semiconductor plasma process equipment, or in applications where a uniform long linear plasma is needed, such as a plasma laser.

As is apparent from the above description, the present invention has the advantage of being able to produce a more uniform discharge over a discharge area wider than the wavelength of the applied high frequency.

INDUSTRIAL APPLICABILITY

As described above, according to the invention, for example, relatively uniform high frequency energy can be applied to a planar or linear discharge space by using an electrodeless discharge energy supply apparatus which comprises a surface wave transmission line for exciting a surface wave by a high frequency, the surface wave transmission line being formed from a conductive material having a periodic array of corrugations, wherein using the surface wave produced in the vicinity of the surface wave transmission line, energy necessary to produce an electrodeless discharge is supplied to an electrodeless discharge tube.

What is claimed is:

1. An electrodeless discharge lamp apparatus comprising:

high frequency oscillation means of generating high frequency energy;

high frequency propagation means of propagating said generated high frequency energy;

an electrodeless discharge energy supply apparatus including a surface wave transmission line having electrical conductivity, configured in a substantially cylindrical or semicylindrical shape including an axial direction, and including a prescribed periodic structure, for exciting a surface wave by the high frequency energy;

high frequency coupling means of coupling said propagated high frequency energy into said electrodeless discharge energy supply apparatus;

an electrodeless discharge lamp in which a discharge is produced by the surface wave generated by said electrodeless discharge energy supply apparatus in the vicinity of said surface wave transmission line; and high frequency leakage prevention means of preventing the high frequency energy from leaking from the electrodeless discharge energy supply apparatus;

wherein at least a portion of said surface wave transmission line is covered with an optically reflective member; and the high frequency leakage prevention means encloses at least the electrodeless discharge energy supply apparatus and the electrodeless discharge lamp, and at least a portion of the high frequency leakage prevention means includes an optically transmissive member.

2. An electrodeless discharge lamp apparatus comprising:

high frequency oscillation means of generating high frequency energy;

high frequency propagation means of propagating said generated high frequency energy;

an electrodeless discharge energy supply apparatus including a surface wave transmission line having electrical conductivity, configured in a substantially cylindrical or semicylindrical shape including an axial direction, and including a prescribed periodic structure, for exciting a surface wave by the high frequency energy;

high frequency coupling means of coupling said propagated high frequency energy into said electrodeless discharge energy supply apparatus;

an electrodeless discharge lamp in which a discharge is produced by the surface wave generated by said electrodeless discharge energy supply apparatus in the vicinity of said surface wave transmission line; and high frequency leakage prevention means of preventing the high frequency energy from leaking from the electrodeless discharge energy supply apparatus;

wherein at least a portion of the interior of said surface wave transmission line includes an optically reflective member; and the high frequency leakage prevention means encloses at least the electrodeless discharge energy supply apparatus and the electrodeless discharge lamp, and at least a portion of the high frequency leakage prevention means includes an optically transmissive member.

3. An electrodeless discharge energy supply apparatus comprising:

a planar corrugated type surface wave transmission line for exciting a surface wave and having corrugations of a conductive material provided at prescribed intervals in a periodic fashion on a planar plate, each corrugation being substantially perpendicular to said planar plate; and an electrodeless discharge element for producing an electrodeless discharge using energy supplied by the excited surface wave.

4. An electrodeless discharge lamp apparatus according to any one of claims 1 to 2, wherein said surface wave transmission line is a cylindrical helix type surface wave transmission line consisting of a conductive strip member configured in the shape of a helix.

5. An electrodeless discharge lamp apparatus according to any one of claims 1 to 2, wherein said surface wave transmission line is a semicylindrical corrugated type surface wave transmission line, the prescribed periodic structure including conductive corrugations provided at prescribed intervals in a periodic fashion inside a semicylindrically shaped conductive structure, each corrugation being substantially perpendicular to said semicylindrical shaped conductive structure.

6. An electrodeless discharge lamp apparatus according to claim 5, wherein a longitudinal direction of the electrodeless discharge lamp is substantially parallel to the axial direction of said cylindrical surface wave transmission line.

7. An electrodeless discharge lamp apparatus according to claim 2, wherein a longitudinal direction of the electrodeless discharge lamp is substantially parallel to the axial direction of said cylindrical surface wave transmission line.

8. An electrodeless discharge lamp apparatus according to claim 1, wherein a longitudinal direction of the electrodeless discharge lamp is substantially parallel to the axial direction of said surface wave transmission line.

9. An electrodeless discharge energy supply apparatus comprising:

a semicylindrical corrugated type surface wave transmission line for exciting a surface wave and including corrugations of a conductive material provided at prescribed intervals in a periodic fashion inside a semicylindrically shaped conductive structure, each corrugation being substantially perpendicular to said semicylindrically shaped conductive structure; and an electrodeless discharge element for producing an electrodeless discharge using energy supplied by the excited surface wave.

* * * * *